US006602462B2

(12) United States Patent
Boulet

(10) Patent No.: US 6,602,462 B2
(45) Date of Patent: Aug. 5, 2003

(54) AUGER PUMP FOR HANDLING MAGNESIUM AND MAGNESIUM ALLOYS

(76) Inventor: Alain Renaud Boulet, 230 York Street, Strathroy, ON (CA), N7G 2T6

( * ) Notice: Subject to any disclaimer, the term of this patent is extended or adjusted under 35 U.S.C. 154(b) by 0 days.

(21) Appl. No.: 09/848,630

(22) Filed: May 3, 2001

(65) Prior Publication Data

US 2001/0048186 A1 Dec. 6, 2001

Related U.S. Application Data

(63) Continuation of application No. 09/409,093, filed on Jul. 26, 1999, now abandoned.

(51) Int. Cl.[7] ..... C21C 5/42
(52) U.S. Cl. ..... 266/237; 222/638; 164/457
(58) Field of Search ..... 266/237; 222/638; 164/457; 416/204; 415/119; 417/424.1, 238, 423.3, 638, 359, 50, 54

(56) References Cited

U.S. PATENT DOCUMENTS

| | | | | |
|---|---|---|---|---|
| 3,252,187 A | | 5/1966 | Burkett | |
| 4,147,474 A | | 4/1979 | Heimdal et al. | |
| 4,598,899 A | * | 7/1986 | Cooper | 266/235 |
| 4,828,459 A | | 5/1989 | Behrens | |
| 4,928,933 A | | 5/1990 | Motomura | |
| 5,028,211 A | | 7/1991 | Mordue et al. | |
| 5,407,000 A | | 4/1995 | Mercer, II et al. | |

* cited by examiner

*Primary Examiner*—Scott Kastler
(74) *Attorney, Agent, or Firm*—Anissimoff & Assoc.; Hans Koenig

(57) ABSTRACT

An auger pump for pumping molten magnesium and its alloys from a furnace to a die casting machine, ingot mould, DC caster or the like is disclosed. The pump is comprised of a linearly aligned upper and lower portion. The upper portion is comprised of a housing which is attached to the furnace lid. An inverter duty electric motor is attached to the top of the housing and is controlled by a PLC. The auger shaft runs longitudinally between each portion and is supported in position by guide bearings located in the upper portion. The lower portion comprises a tubular casing which contains a gas inlet aperture and an feeder inlet aperture for drawing the molten magnesium into the pump. The outlet of the pump, a connector, is attached to a heated transfer tube, which conveys the molten magnesium to the mould.

13 Claims, 2 Drawing Sheets

AUGER PUMP FOR HANDLING MAGNESIUM AND MAGNESIUM ALLOYS

This application is a continuation of U.S. Ser. No. 09/409,093 filed Jul. 26, 1999, now abandoned.

BACKGROUND OF THE INVENTION

1. Field of the Invention

The present invention relates to pumps used to transfer measured quantities of molten metal from a furnace to a die casting machine, ingot mould, DC caster or the like. In particular, the present invention relates to positive displacement pumps which are used with high melting point metals such as molten magnesium and its alloys.

2. Prior Art

There has been a steady increase in the use of magnesium and its alloys in the die casting industry especially as it relates to the automotive manufacturing sector. An explanation for the increase is that castings made of magnesium, in comparison to steel and aluminum, are lightweight but have equal or superior strength characteristics.

Special precautions and handling requirements must be taken with molten magnesium (which term shall be used hereinafter to include its alloys). The molten metal is highly volatile and bums when exposed to the atmosphere requiring the use of inert gases such as Argon or toxic gases such as sulfur tetrafluoride ($SF_6$) and sulfur dioxide ($SO_2$) to eliminate burning. The high melting point of magnesium also poses special considerations in designing a reliable pump.

There are various types of pumps available for delivering measured quantities of molten metal to die casting machines. Gas displacement, electromagnetic, centrifugal and positive displacement pumps are the general types of pumps used in the industry. The die casting machine receives a measured quantity of molten metal known as a shot which is used to make a casting. Both the quantity or metal delivered and the reliability of the delivery mechanism as described hereinafter are most important for reliable manufacturing casting operations.

Typically, the pump operates in conjunction with a transfer tube to deliver a shot to the die casting machine. As such the pump transfers a quantity of molten metal from the magnesium melt furnace into the tube for delivery to the die.

Gas displacement pumps use gas pressure to displace molten metal from a sealed vessel into a heated transfer tube which is submerged in the molten metal. Typically an inert gas is used to displace the molten magnesium through the transfer tube. However, this arrangement does not deliver sufficiently accurate shots. One reason for this is that the gas medium used to displace the molten metal by means of compression itself depends on temperature for its compression efficiency. As well, over time build up of magnesium occurs inside the tube creating increased resistance to the movement of molten magnesium through it. In addition, these pumps contain internal valves that are prone to clogging and are difficult to replace.

Electromagnetic pumps such as helical magnetic pumps, centrifugal electromagnetic pumps, flat linear induction pumps, and annular linear induction pumps use a magnetic force to induce current flow in a conducting fluid. The reaction to the flux causes a force to be exerted on the fluid so that pumping action takes place. Such pumps have no moving parts and can usefully transfer large volumes of metal but they are also inefficient and expensive.

For example, U.S. Pat. No. 5,407,000 to Mercer, II et al., discloses the use of an annular linear induction electromagnetic pump as part of a method and apparatus for handling molten metals. This pump is expensive and its accuracy depends on the viscosity of the molten metal which is variable. Temperature changes in the holding furnace affects the viscosity of the molten metal and ultimately, the size of the shots.

Centrifugal pumps comprise a cylinder with an internal rotating impeller which produces the necessary head pressure. Such pumps are typically used for transferring large quantities of molten metal but are incapable of delivering accurate small quantity shots.

Positive displacement pumps typically use a piston or plunger to displace and move the molten metal. One problem with this arrangement is that molten metal enters the space between the piston and the containing wall contributing to the clogging and unserviceability associated with this type of pump.

As well, most of the above mentioned pumps contain valves, guides and bearings which come in contact with the molten metal leaving them prone to failure and damage.

BRIEF SUMMARY OF THE INVENTION

An object of this invention is provide a pump for transferring molten magnesium to a die casting machine that is simple in construction, effective, easy to use and maintain, and is relatively inexpensive to manufacture.

A further object of the invention is to provide a pump which does not have any valves, guides, bearings or the like, in contact with molten magnesium, thus making the pump less vulnerable to failure and more reliable.

A further object of the invention is to provide a pump which constantly agitates the molten metal in the magnesium melt furnace. The agitation assists in keeping a constant bath temperature in the furnace when ingots are introduced into the bath. Maintaining a constant temperature in the bath improves consistency and aids in preventing the premature release and deposits of magnesium metal alloys.

Agitation in the molten bath also assists in stabilizing the viscosity of the molten metal. Maintaining a consistent viscosity improves both pour speed and pour. Pour time relates to the amount of time required for the pump to change from idle to pour speed. The agitation is achieved by the auger which continues to rotate at idle speed to maintain a head in the transfer tube as described hereinafter. Naturally, at pour speed, the agitation is further increased. The agitation stabilizes the bath's temperature quickly, substantially reducing the amounts of alloy deposits and variations in viscosity.

In the present invention, a molten magnesium pump comprises an upper and lower portion. The upper portion consists of an inverter duty electric motor which is operatively connected to a PLC. The PLC controls output by the motor thereby controlling the pour speed and pour time of the pump. A coupler attaches the motor to the auger shaft. The shaft is centered and aligned between upper and lower portions. The shaft is held in position by various guide bearings located exclusively within the upper portion.

The lower portion comprises a cylindrical casing which is immersed in the molten magnesium bath. The top portion of the casing contains a gas inlet aperture in which gases such as argon, $SF_6$ or $SO_2$ are fed. Located near the base of the casing is an inlet aperture which permits the molten magnesium to enter the pump casing. As the auger shaft is rotated by the motor, displacing the molten magnesium downwardly and forcing it out of the pump and into the heated transfer tube for delivery to the die casting machine. At idle speed, the auger maintains a head of metal in the transfer tube and agitates the molten metal in the bath.

Further objects and features of the present invention will become apparent to those skilled in the art in the light of the following description and accompanying drawings

BRIEF DESCRIPTION OF THE DRAWINGS

In the accompanying drawings which form part of the specification and are to be read in conjunction therewith and in which like reference numerals are used to indicated like parts in the various views.

BRIEF DESCRIPTION OF THE INVENTION

Figure 1:
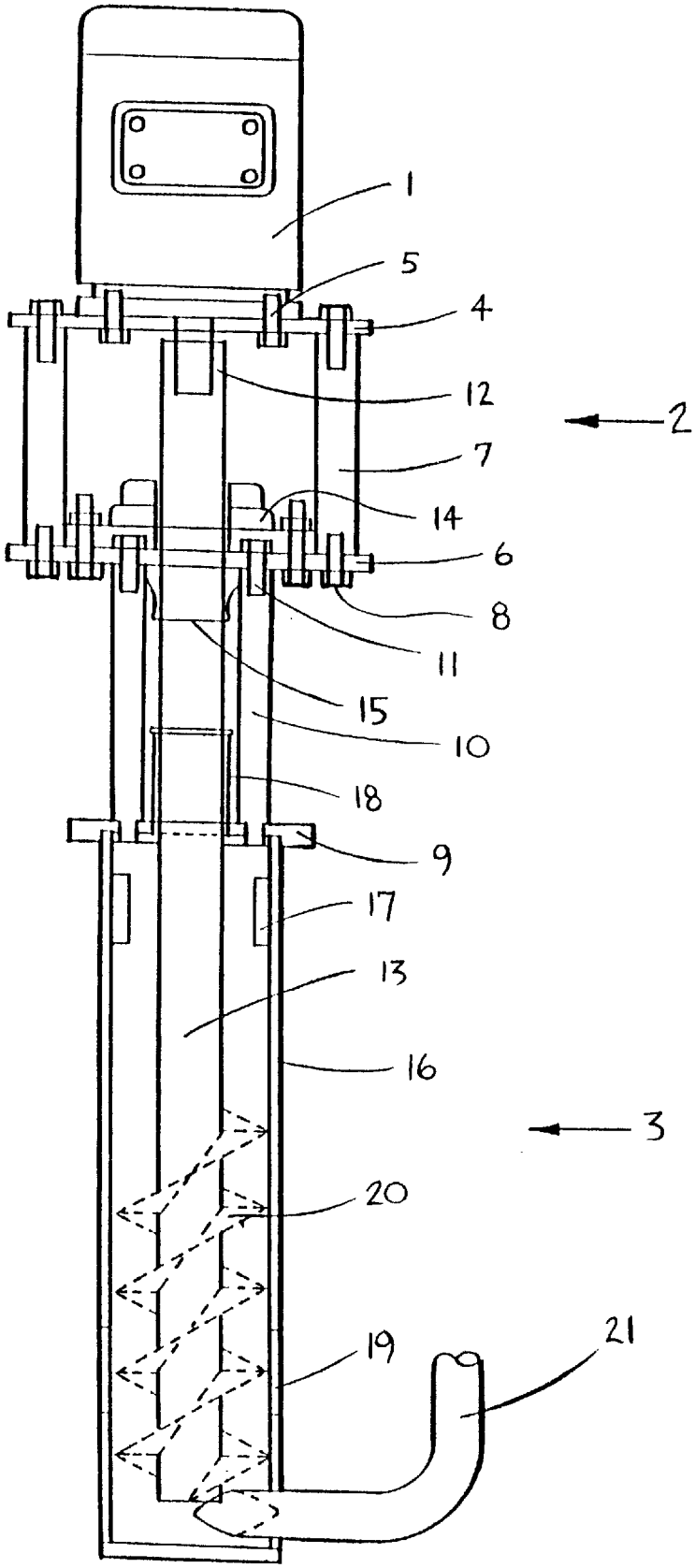
FIG. 1—a perspective view of the pump according to the present invention as positioned in a bath of molten magnesium FIG. 2—a perspective view of the pump according to the present invention as shown attached to a heated transfer tube
Figure 2:
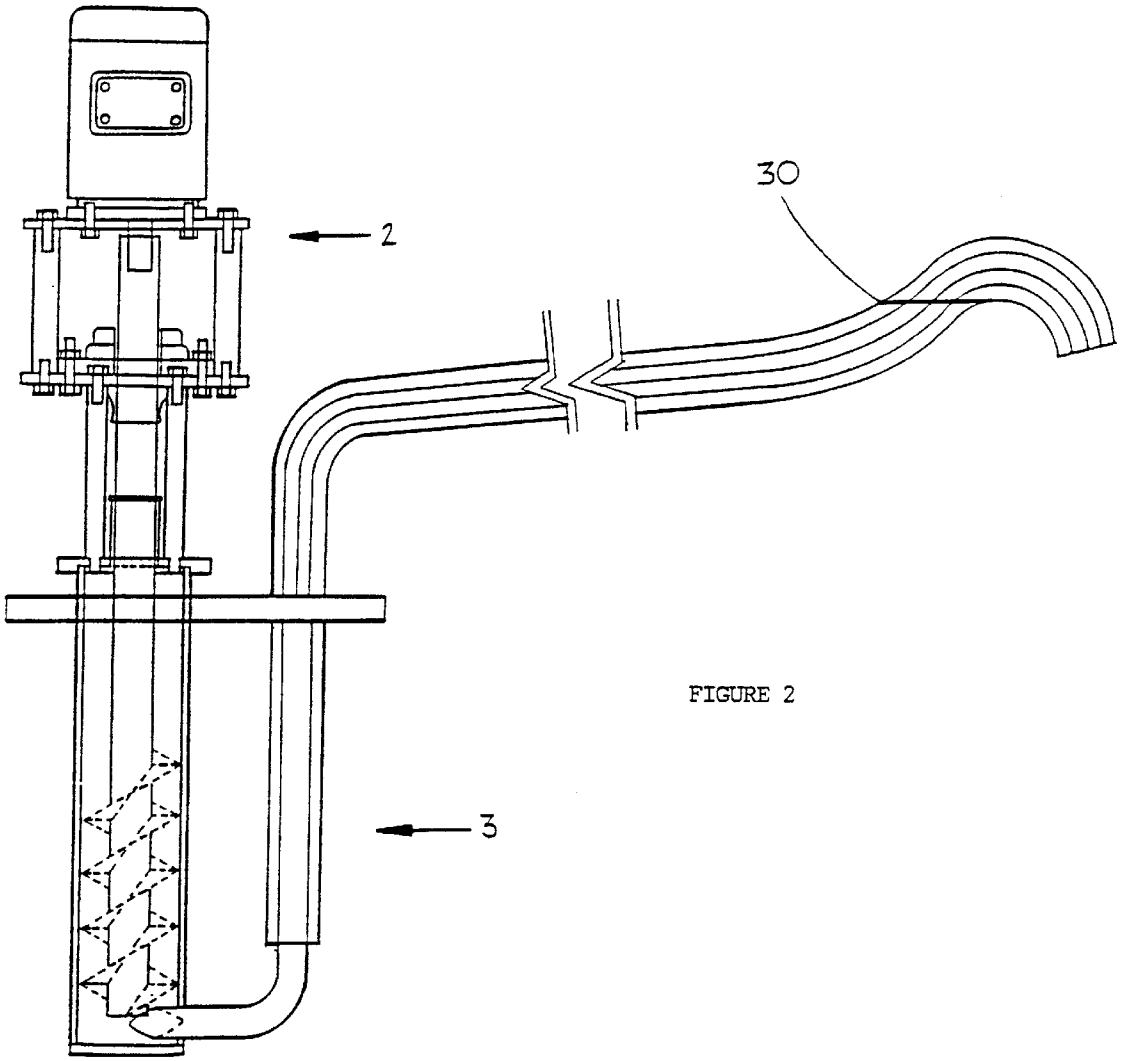

Referring to FIGS. 1 and 2, a preferred embodiment of the present invention is illustrated. The pump apparatus shown in FIG. 1 is attached to the magnesium furnace and is located above the bath of molten magnesium. The auger and the cylindrical casing enclosing it are operatively immersed in the bath.

The inverter duty electric motor (1) is operatively connected to the vector high frequency drive which in turn, is operatively connected to a programmable logic controller (PLC) (not shown). The PLC is programmed to control the level of power delivered to the pump and the duration of operation of the pump. Specifically, the PLC controls the vector high frequency drive. The drive controls the amount of Hertz delivered to the motor thereby controlling the pour speed and the pour time of the pump.

The pump consists of 2 main parts, the upper portion (2) which is suspended above the molten magnesium bath during operation and the lower portion (3) which is immersed in the bath. The motor (1) is positioned at the top of the upper portion, resting on a steel plate (4) which is slightly larger in diameter than the motor itself. Two bolts (5) are threadingly engaged with the base of the steel plate and the motor, securing the motor in place. The steel plate (4) is attached to a second steel plate (6) by four cylindrical bars (7) running longitudinally between the two plates and bolted (8) to each plate on either end. The second plate (6) is in turn, attached to a third plate (9) located at the top of the lower portion (3) by four cylindrical bars (10) running longitudinally between the plates. The bars are bolted (11) on either end to each plate. The two sets of cylindrical rods (7, 10) permits the easy handling of the pump apparatus while providing it with support.

A holding bearing or coupler (12) is located beneath the first plate and is attached to the auger shaft (13) and the motor (1). The holding bearing (12) holds the weight of the auger shaft (13) and positions it in place. The auger shaft (13) is centered within the internal diameter of the two portions, running the length of both, held in position by a set of guide bearings(14, 15) located on either face of the second plate.

The lower portion is comprised of a cylindrical casing (16) in which the auger is located and aligned. Several inlet holes are located in the walls of the cylindrical casing. Two gas inlet apertures (17) are located near the top of the cylinder, in a portion of the cylindrical casing that remains above the level of the bath. Protective gases such as argon, $SO_2$ or $SF_6$ are introduced into the casing by means of the apertures. A sealing cap (18) placed on top of the pump casing functions to seal the casing and contain the protective gases within. A seal is achieved by surrounding the internal diameter of the sealing cap (18) with graphite rope (not shown).

A second set of inlet holes (19) in the cylindrical casing are located near the base of the pump. These inlet holes permit the surrounding molten metal to enter the pump.

The auger comprises a shaft, upon which are welded flutes. The pitch of the flutes preferably varies between 2 to 4 inches depending on the application. For instance, when a large volume is required, a 4 inch pitch should be used. In contrast, a 2 inch pitch provides the accuracy required to pour a small volume of molten magnesium.

The auger (20) acts like a positive displacement pump. Typically, displacement is impeded by slippage of material past the auger. However, the density of magnesium is approximately twice that of water, resulting in a substantial decrease in slippage. As a result, the rotation of the auger shaft by the motor supplies a steady force to the molten magnesium, forcing the molten liquid to the bottom of the pump and out of the connector (21).

The elbow shaped connector (21) is located at the outlet end of the cylindrical casing at the base of the pump. The molten magnesium displaced to the bottom of the pump is downwardly forced out through the connector by means of the rotation of the auger. Referring to FIG. 2, the connector (21) is attached to a heated transfer tube (30) which will convey the molten magnesium from the holding furnace to the die of the casting machine (not shown).

The effect of the inverter duty electric motor rotating the auger at idle speed results in a downward displacement of molten magnesium that allows for the maintenance and control of a head of molten metal at the end of the heated transfer tube. This also permits the near instantaneous acceleration and deceleration of the molten magnesium transfer at a pre-determined rate and quantity when the pump operates at pour speed. A resulting benefit of this system is consistent and accurate shots of molten magnesium into a die cast machine.

From the foregoing, it will be seen that this invention is one well adapted to attain all the ends and objects hereinabove set forth together with other advantages which are obvious and which are inherent to the structure.

It will be understood that certain features and sub-combinations are of utility and may be employed without reference to other features and sub-combinations. This is contemplated by and is within the scope of the claims.

Since many possible embodiments may be made of the invention without departing from the scope of the thereof, it is to be understood that all matter herein set forth or shown in the accompanying drawings is to be interpreted as illustrative and not in a limiting sense.

What is claimed is:

1. A molten metal pump for transferring metal from a melt furnace by means of a transfer comprising upper and lower aligned portions said upper portion comprising a frame housing for attachment to the melt furnace, an inverter duty electric motor mounted within said housing frame; said lower portion attached to said upper portion and immersable into the melt furnace comprising a cylindrical casing having an opening at the bottom thereof, a transfer tube connected at one end to said opening, and an auger within said casing connected to said inverter duty electric motor by means of a shaft, said opening being located lower than a bottom flute of the auger, said motor being operable at a first speed to rotate said shaft to transfer metal downwardly into the transfer tube in order to maintain a predetermined head within the tube and being further operable at a second speed to transfer a measured quantity of molten metal from the tube.

2. The pump as claimed in claim 1, wherein said cylindrical casing is vented to said melt furnace by means of a set of inlet apertures in which molten metal may enter the casing.

3. The pump as claimed in claim 2 wherein said cylindrical casing contains a set of gas inlet apertures at the top through which a protective gas may be introduced.

4. The pump as claimed in claim 3 wherein said transfer tube may be heated.

5. A pump for transferring a molten metal from a melt furnace, comprising:

a variable speed motor;

a transfer tube, comprising an elbow shaped connector and a vertical portion for maintaining a predetermined head level of the molten metal;

a frame housing with means for attaching the pump to the melt furnace;

a means for mounting the motor in the frame housing;

a cylindrical casing, vertically aligned with the frame housing and at least partially immersible in the molten metal, a first opening in the casing at a bottom thereof, connecting an interior of the casing to the elbow shaped connector of the transfer tube, and at least one second opening for admitting the molten metal to the interior of the casing; and a shaft, rotatingly coupled to the motor at a first end thereof and having flutes formed on a portion adjacent a second end thereof to define an auger portion, the flutes being located above the first opening in the casing, the motor coupling positioned in the frame housing and the auger portion positioned in the cylindrical casing;

wherein the variable speed motor operates at a first speed to rotate the auger, pushing molten metal downwardly into the transfer tube in order to maintain the predetermined head level and operates at a second speed to transfer a quantity of molten metal from the tube.

6. The pump of claim 5 wherein the motor is an inverter duty electric motor.

7. The pump of claim 5 wherein the lower portion has at least one third opening near the top thereof, said at least one third opening admitting a gas into the interior of the casing.

8. The pump of claim 5 wherein the transfer tube further comprises a horizontal portion for transporting the molten metal from the melt furnace.

9. The pump of claim 8 wherein at least the horizontal portion of the transfer tube is heated.

10. The pump of claim 5 wherein the weight of the shaft is borne by a holding bearing in the upper portion.

11. The pump of claim 5 wherein the shaft is held in alignment by at least one set of guide bearings in the upper portion.

12. The pump of claim 5 wherein the weight of the cylindrical casing is borne by the frame housing.

13. A pump for transferring a molten metal from a melt furnace, comprising:

a means for providing drive torque;

a transfer tube with a vertical portion for maintaining a predetermined head level of the molten metal;

a frame housing with means for mounting the drive torque means;

an auger housing, vertically aligned with the frame housing and at least partially immersible in the molten metal, a first opening in the casing at a bottom thereof communicating an interior of the auger housing to the transfer tube, and at least one second opening for admitting the molten metal to the interior of the auger housing; and an auger shaft, rotatingly coupled to the drive torque means at a first end thereof and having flutes formed on a portion adjacent a second end thereof to define an auger portion, the flutes being located above the first opening in the casing, the coupling positioned in the frame housing and the auger portion positioned in the auger housing;

wherein the drive torque means operates at a first speed to rotate the auger shaft, pushing molten metal downwardly into the transfer tube in order to maintain the predetermined head level and operates at a second speed to transfer a quantity of molten metal from the tube.

* * * * *